US005279914A

United States Patent [19]

Aizawa et al.

[11] Patent Number: 5,279,914

[45] Date of Patent: Jan. 18, 1994

[54] PHOTOCONDUCTOR FOR ELECTROPHOTOGRAPHY HAVING AN UNDERCOAT LAYER

[75] Inventors: Kouichi Aizawa; Takashi Obinata, both of Kawasaki, Japan

[73] Assignee: Fuji Electric Co., Ltd., Kanagawa, Japan

[21] Appl. No.: 899,274

[22] Filed: Jun. 16, 1992

[30] Foreign Application Priority Data

Jun. 18, 1991 [JP] Japan ..... 3-145037

[51] Int. Cl.[5] ..... G03G 5/047; G03G 5/14

[52] U.S. Cl. ..... 430/59; 430/58; 430/60; 430/64

[58] Field of Search ..... 430/58, 60, 62, 64, 430/59

[56] References Cited

U.S. PATENT DOCUMENTS 5,071,723 12/1991 Koyama et al. ..... 430/64 X
5,075,171 12/1991 Kondo et al. ..... 430/411.1
5,075,189 12/1991 Ichino et al. ..... 430/60 X

FOREIGN PATENT DOCUMENTS 48-47344 7/1973 Japan .
49-69332 7/1974 Japan .
52-10138 1/1977 Japan .
52-25638 2/1977 Japan .
58-30757 2/1983 Japan .
58-63945 4/1983 Japan .
58-95351 6/1983 Japan .
58-98739 6/1983 Japan .
58-105155 6/1983 Japan .
60-66258 4/1985 Japan .

OTHER PUBLICATIONS

Teuscher, Xerox Discl. Jour., vol. 10, No. 1, Jan.-Feb. 1985, p. 57

*Primary Examiner*—Roland Martin
*Attorney, Agent, or Firm*—Spencer, Frank & Schneider

[57] ABSTRACT

A photoconductor for electrophotography is composed of a conductive substrate, an undercoat layer formed on the conductive substrate, a charge generating layer formed on the undercoat layer and a charge transporting layer formed on the charge generating layer. The undercoat layer comprises a crosslinked polyamide represented by the following formula, wherein m and n stand for positive integers.

4 Claims, 3 Drawing Sheets

PHOTOCONDUCTOR FOR ELECTROPHOTOGRAPHY HAVING AN UNDERCOAT LAYER

BACKGROUND OF THE INVENTION

1. Field of the Invention

The present invention relates to a photoconductor for electrophotography and more particularly to a photoconductor having an undercoat layer for preventing the influence by the circumferential humidity and improving reliability thereof.

2. Description of the Prior Art

Up to the present, a low-price and pollution-free organic photosensitive material is used generally as a photoconductor for electrophotography (hereinafter to be referred to as a photoconductor) used in copying apparatuses of an electrophotographic system. Various photoconductors are known, for instance, a photoconductive resin type represented by polyvinylcarbazole (PVK), an electron-transfer complex type represented by PVK-TNF (2, 4, 7 trinitrofluorene), a pigment dispersion type represented by a phthalocyanine binder and a functionally distinguishable type using a charge generating substance in combination with a charge transporting substance. Among them, a functionally distinguishable photoconductor is specifically noticed.

When the Carlson process is used for image formation, these high sensitive photoconductors of functionally distinguishable organic types have the following problems:

(1) The photoconductor is hardly electrificated and its ability to retain an electric charge is poor, that is, the dark attenuation is high and the deterioration of characteristics is considerably high in repeated use.

(2) Non-uniformity of density and fog happen on the images obtained.

(3) Scumming happens in the case of the reversal development.

For the purpose of solving the above-mentioned problems, it is known that an intermediate layer is provided between a conductive substrate and a photosensitive layer as an undercoat layer of the photosensitive layer. The intermediate layers in which use are made of nylon type resins are disclosed in Japanese Patent Application Laying-open Nos. 47344/1973, 25638/1977, 30757/1983, 63945/1983, 95351/1983, 98739/1983 and 66258/1985. The intermediate layers in which use are made of maleic acid type resins are disclosed in Japanese Patent Application Laying-open Nos. 69332/1974 and 10138/1977. In addition, an intermediate layer in which use is made of polyvinylalcohol resin is disclosed in Japanese Patent Application Laying-open No. 105155/1983.

However, since an insulating resin is used as the undercoat layer in many cases, there were problems that the residual voltage of the photoconductor became high and the contrast of an image became poor. When a polyamide (Nylon(Trademark)) having a low electric resistance is used, it is possible to control the residual voltage. However, since a polyamide has a high water absorption, the characteristics of the photoconductor vary under the influence of a circumferencial humidity. For instance, in the reversal development system, fog occures under a high humidity circumstance and a density of the image decreases under a low humidity circumstance. In addition, there were also problems that the adhesion of a polyamide to an aluminum substrate with a rough surface is poor and it is impossible to cover the pinholes of the surface of the substrate.

SUMMARY OF THE INVENTION

An object of the present invention is to provide a photoconductor for electrophotography having an improved undercoat layer for preventing the photoconductor from the influence by the circumferential condition so that the variation of the photoconductor becomes less and the image with a high resolution and a high contrast can be stably obtained with a photoconductor for electrophotography.

Another object of the present invention is to provide a photoconductor for electrophotography having an undercoat layer which has a good adhesive property against a conductive substrate.

In the aspect of the present invention, a photoconductor for electrophotography comprises:

a conductive substrate;

an undercoat layer formed on the conductive substrate and comprises a crosslinked polyamide represented by the following formula:

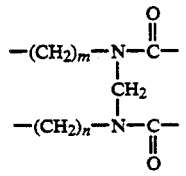

wherein m and n stand for positive integers, a charge generating layer formed on the undercoat layer; and a charge transporting layer formed on the charge generating layer.

The crosslinked polyamide may be N-methoxy methylated by a copolymer polyamide and treated with an organic acid.

The crosslinked polyamide may be N-methoxy methylated by a graftcopolymer polyamide and treated with with oxalic acid.

The thickness of the undercoat layer may be within the range from 0.1 μm to 20 μm.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
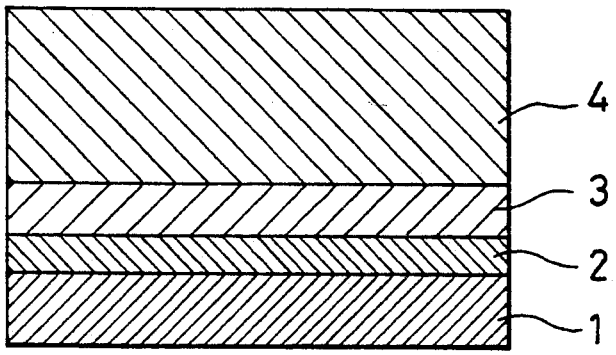
FIG. 1 is a schematic cross-sectional view showing a photoconductor for electrophotography according to the present invention.

FIG. 1 shows a schematic cross-sectional view of a photoconductor for electrophotography according to the present invention.

An undercoat layer 2 is formed on a conductive substrate 1 and a charge generating layer 3 is formed on the undercoat layer 2. In addition, a charge transporting layer 4 is formed on the charge generating layer 3.

The conductive substrate is prepared by depositing or sputtering a metal such as aluminum, nickel, chrome, copper, silver, gold or platinum, or a metallic oxide such as tin oxide, indium oxide on a plastic or a paper of a shape of film or cylinder.

The conductive substrate may be a plate such as aluminum, aluminum alloy, nickel or stainless steel or may be a tube made by extruding or drawing aforementioned metals or alloys.

The maximum roughness defined by ISO R468 of the surface of the conductive substrate is within the range from about 0.5 μm to 10 μm. In addition, for the purpose of smoothing the surface of the conductive substrate, the tube may be treated by cutting, ultra finishing or abrasion.

A thickness of the undercoat layer is within the range from about 0.1 to 20 μm, preferably, from 0.5 μm to 15 μm.

The charge generating layer 3 includes a charge generating substrance as a main material and if necessary, a binder may be added. Usable charge generating substances include a phthalocyanine type pigment such as titanylphthalocyanine, metal-free phthalocyanine and aluminum phthalocyanine, an azulenium salt and an azo pigment.

A suitable thickness of the charge generating layer is within the range from about 0.01 μm to 5 μm and a preferable thickness of the charge generating layer is within the range from 0.03 μm to 2 μm.

The charge transporting substance and, if necessary, a binder resin are dissolved or dispersed into a suitable solvent to produce a coating liquid. The coating liquid is applied onto the charge generating layer 3 and dried to form the charge transporting layer 4.

The charge transporting substances include hydrazone, pyrazoline, butadiene, anthracene, poly-N-vinylcarlazole and the derivatives thereof.

Usable binder resins include a thermoplastic resin or a thermosetting rein such as polystyrene, stylene/acrylonitrile copolymer, styrene/butadiene copolymer, styrene/maleic anhydride copolymer, polyester, polyvinyl chloride, vinyl chloride/vinyl acetate copolymer, polyvinyl acetate, polyvinylidene chloride, polyacrylate resin, phenoxy resin, polycarbonate, cellulose acetate resin, ethylene cellulose resin, polyvinylbutyral, polyvinylformal, polyvinyltoluene, poly-N-vinylcarbazole, acrylic resin, silicone resin, epoxy resin, melamine resin, urethane resin, phenolic resin, and alkyd resin.

A plasticizer, an ultraviolet absorption agent, an antioxidant, and/or a leveling agent may be added in the charge transporting layer 4 if necessary.

EXAMPLE 1

10 parts by weight of an alcohol-soluble graftcopolymer polyamide (manufactured by Toray Co., Ltd.: CM8000) was dissolved into a mixed solvent of 70 parts by weight of methanol and 30 parts by weight of dichloroethane while agitating for 5 hours at room temperature.

Since the graftcopolymer polyamide has a high solubility, it facilitates to prepare a crosslinked polyamide solution. 3 parts by weight of p-formaldhyde was mixed in the resultant solution, so that the polyamide was N-methoxy methylated, that is, $N(CH_2—O—C—H_3)$ was prepared.

Subsequently, a coating solution for an undercoat layer was produced by adding 0.03 part by weight of oxalic acid to the aforementioned solution.

An aluminum alloy drum (60 mm in outer diameter, 247 mm in length) with a maximum surface roughness of 1.0 μm was immersed into the coating solution and pulled up to coat the coating solution and dried thereafter at a temperature of 120° C. for 20 minutes. The graftcopolymer polyamide is crosslinked with the methylene group $CH_2$ by means of this heat treatment as shown in the formula (I)

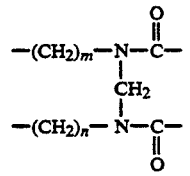

(I)

wherein m and n stand for positive integers.

The thickness of the undercoat layer after heat treatment was 2 μm. Aluminum phthalocyanine dichloride was heated and sublimed under a vacuum of $10^{-5}$ Torr and at a temperature of 300° C. to form a charge generating layer with a thickness of 600 Å on the undercoat layer, and then the drum was immersed into dichloromethane for 10 minutes, so that the charge generating layer including crystalline aluminum phtalocyanine was obtained.

Subsequently, 18 parts by weight of poly (2, 6-dimethylanthracene-9, 10-diolyl dodecanedioate) resin was mixed into 87 parts by weight of 1, 2, 3-trichloropropane and dissolved at a temperature of 97° C. to produce a coating solution. The coating solution was applied onto the charge generating layer to form the charge transporting layer with a thickness of 16 μm.

The photoconductor thus obtained was equipped with a laser beam printer NL 3401-002 (manufactured by Nihon Denki Co., Ltd.), and printing tests were carried out in various environmental circumstances, as a result, good printing was obtained, and besides, a clear image was obtained after the test of printing of forty thousands pages.

EXAMPLE 2

10 parts by weight of N-methoxy methylated nylon (manufactured by Unitika Co., Ltd. T-8 Nylon (Trademark)) was dissolved into a mixed solvent of 70 parts by weight of methanol and 30 parts by weight of dichloromethane and further 0.03 part by weight of oxalic acid was added into a resultant solution to obtain a coating liquid for the undercoat layer.

An aluminum alloy drum (60 mm in outer diameter, 247 mm in length) with the maximum surface roughness of 1.0 μm was immersed into the coating liquid and pulled up to coat the undercoat layer and dried at a temperature of 120° C. for 20 minutes. Polyamide was crosslinked by this heat treatment. The thickness of the undercoat layer after heat treatment was 2 μm.

100 parts by weight of metal-free phthalocyanine of an X type and 100 parts by weight of vinyl chloride/vinyl acetate copolymer were mixed into 100 parts by weight of dichloromethane and dispersed with a ball mill for 24 hours to obtain a dispersion solution. The dispersion solution was applied on the undercoat layer to form the charge generating layer with a thickness of 0.2 μm by the immersion method.

Subsequently, 100 parts by weight of the charge transporting substance represented by the chemical formula (II) and 100 parts by weight of polycarbonate (manufactured by Mitsubishi Gas Chemical Co., Ltd. Upilone Z-300 (trademark)) were dissolved into 800 parts by weight of dichloromethane and further 0.5 part by weight of silicone oil was added. Thus obtained solution was coated onto the charge generating layer to form the charge transporting layer with a thickness of 20 μm.

(II)

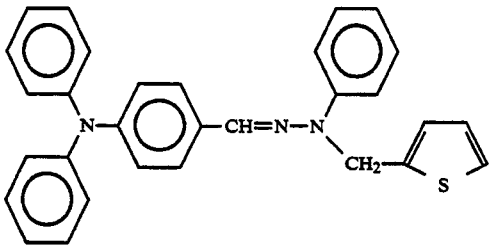

COMPARATIVE EXAMPLE 1

A photoconductor was prepared by the same manner as in Example 2 except that only the alcohol-soluble polyamide without oxalic acid was used as an undercoat layer in other words the polyamide was not crosslinked.

The photoconductor of example 2 and the photoconductor of comparative example 1 were equipped with an LED laser printer PCPR-601 (manufactured by Nihon Denki Co., Ltd.), respectively. Printing tests were carried out under environmental circumstances at a high temperature and a high humidity (35° C., 85% relative humidity (RH)) condition, and at a low temperature and a low humidity (10° C., 30% RH) condition, respectively. As a result, good images having a high contrast and a high resolution against fine lines were obtained in both environmental circumstances with respect to the photoconductor of example 2.

On the contrary, the photoconductor of comparative example 1 was unsuitable for practical applications, because the fog on a white paper and the froadening of fine lines occured at a high temperature and a high humidity, and, an image density on a black paper decreased and the width of fine lines became narrower at a low temperature and a low humidity.

From these results, it is clear that a crosslinked polyamide is superior to a non-crosslinked polyamide as a material of the undercoat layer.

The photoconductor of example 2 gave a good image in a continuous printing test of ten thousands pages. However, the photoconductor of comparative example 1 was not preferable for practical applications, because a density of printed letters is lowered after the printing test of one thousand pages.

EXAMPLE 3

10 parts by weight of N-methoxy methyl nylon was dissolved into a mixed solvent of 70 parts by weight of methanol and 30 parts by weight of dichloromethane and further 0.03 part by weight of oxalic acid was added to produce a coating liquid for the undercoat layer.

An aluminum alloy drum (80 mm in outer diameter, 400 mm in length) with the maximum surface roughness of 0.8 μm was immersed in the coating liquid and pulled up to coat the undercoat layer and dried at a temperature of 120° C. for 20 minutes. The polyamide was crosslinked by this heat treatment. The thickness of the undercoat layer after heat treatment was 2.0 μm.

The drum was swung in dichloromethane for 30 seconds for the purpose of removing a residual oxalic acid on the surface of the undercoat layer. The charge generating layer and the charge transporting layer were formed by the same method as in example 1, so that a photoconductor was produced.

COMPARATIVE EXAMPLE 2

Undercoat layer was formed with N-methoxy methylated nylon with no addition of oxalic acid in liew of oxalic acid treated by N-methoxy methylated nylon as example 3. A charge generating layer and then a charge transporting layer were formed by the same method as in example 2, so that a photoconductor was produced.

The photoconductor of example 3 and the photoconductor of comparative example 2 were equipped with a laser beam printer NL 3401-002 (manufactured by Nihon Denki Co., Ltd.), respectively. Printing tests were carried out in various environmental circumstances. The printing quality obtained by the tests are shown in Table 1.

TABLE 1

| | 10° C. 30% RH | 25° C. 50% RH | 35° C. 85% RH | 35° C. 90% RH |
|---|---|---|---|---|
| Example 3 | good | good | good | good |
| Comparative Example 2 | good | good | no problem | poor |

The photoconductor of comparative example 2 produced fog at high humidities. Although this photoconductor can be used at a humidity of 85% or less, it is clear that a crosslinked polyamide is more preferable.

Figure 2:
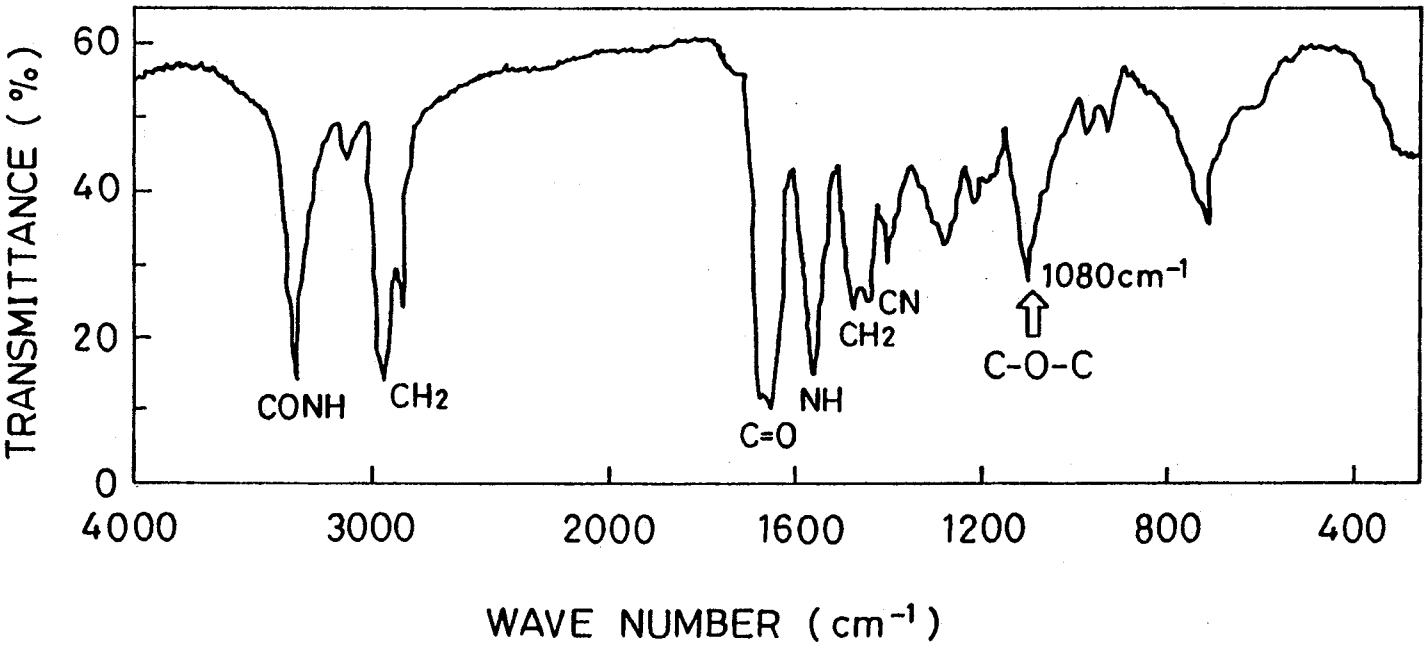
FIG. 2 is a diagram showing an IR spectrum of an N-methoxy methylated polyamide.
Figure 3:
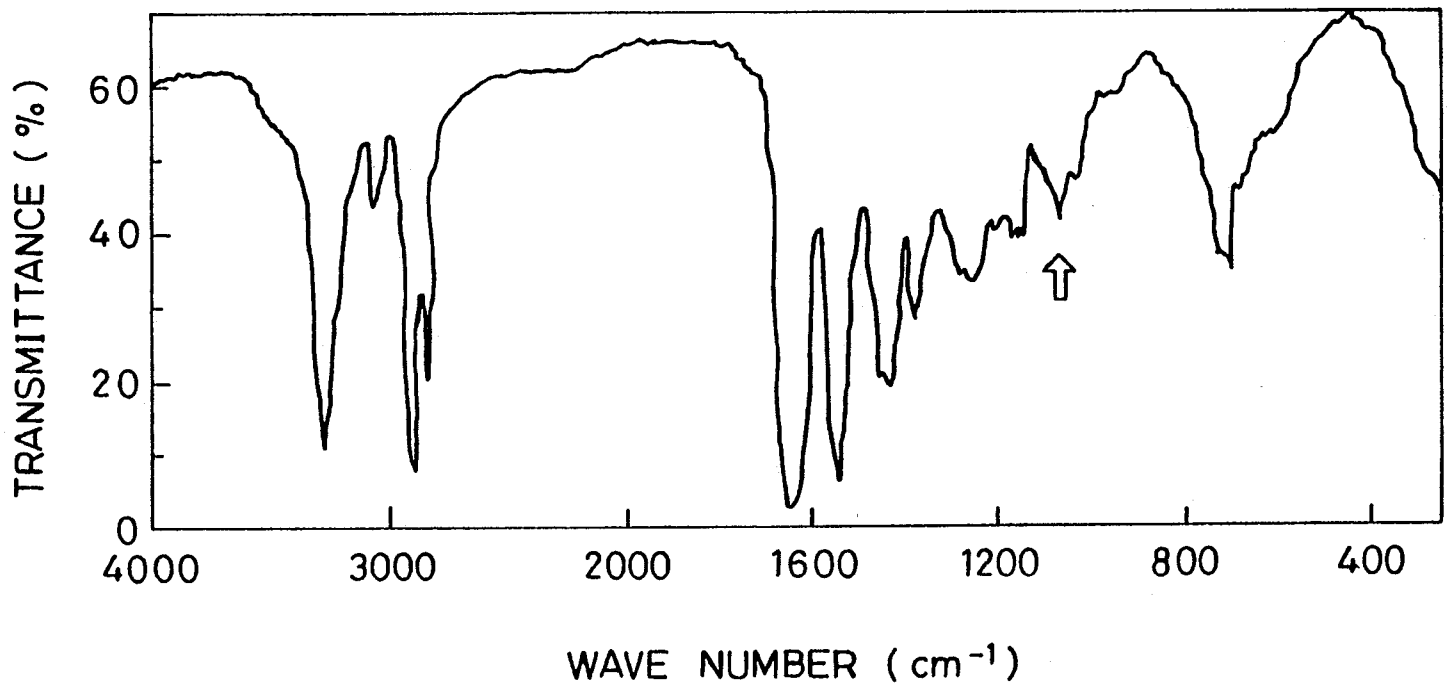
FIG. 3 is a diagram showing an IR spectrum of a crosslinked polyamide.

FIG. 2 shows an IR spectrum of N-methoxy methylated polyamide and FIG. 3 shows an IR spectrum of a crosslinked polyamide treated by oxalic acid. It is understood that a C—O—C vibration corresponding to the methoxy methyl group vanishes.

EXAMPLE 4

An aluminum alloy drum with the maximum surface roughness of 2 μm was used as a conductive substrate, and then an undercoat layer, a charge generating layer and a charge transporting layer were formed by the same method as in example 2, so that a photoconductor was produced.

The initial adhesion of the undercoat layer to the aluminum drum in this photoconductor was good and the peeling did not take place with a peeling test. While, when the undercoat layer was made of the non-crosslinked polyamide, the adhesion of the undercoat layer to the drum was poor and the photoconductor was unpractiable.

EXAMPLE 5

A photoconductor was produced by forming an undercoat layer with the same thickness of the surface roughness of an aluminum alloy drum. The respective undercoat layers were formed by using a crosslinked N-methoxy methylated nylon and non-crosslinked N-methoxy methylated nylon (comparative example 2).

The adhesions of the undercoat layers to the drums were evaluated after printing tests of ten thousands pages. The results obtained are shown in Table 2.

TABLE 2

| | | | | | | |
|---|---|---|---|---|---|---|
| maximum surface roughness (μm) | 0.3 | 0.5 | 0.7 | 1.0 | 2.0 | 5.0 |
| the thickness of the undercoat layer (μm) | 0.3 | 0.5 | 0.7 | 1.0 | 2.0 | 5.0 |
| the undercoat layer comprising a crosslinked polyamide | good | good | good | good | good | good |
| the undercoat layer comprising a non-crosslinked polyamide | good | | | poor | poor | poor |

The term "good" means that the adhesion of the undercoat layer to the aluminum alloy drum was good after the test.

The term "poor" means that the undercoat layer was peeled from alluminum alloy drum after the test. The undercoat layer which is formed with a crosslinked polyamide shows a good adhesion in spite of the maximum surface roughness of the substrate more than 0.5 μm after the printing test of ten thousands pages. On the contrary, when the undercoat layer of non-crosslinked polyamide explained in comparative example 2 was used, the adhesion of the undercoat layer to the substrate was good at an only initial stage when the thickness of the undercoat layers were 0.5 μm and 0.7 μm.

According to the present invention, the adhesion of the undercoat layer to the conductive substrate is improved by crosslinking a polyamide. When a polyamide is crosslinked, the dependence of the undercoat layer on a water content becomes low and the dependence of the undercoat layer on a circumferential condition also becomes low. And further the deterioration in repeated use is lowered.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A photoconductor for electrophotography, comprising:

a conductive substrate;

an undercoat layer formed on said conductive substrate and comprised of a crosslinked polyamide represented by:

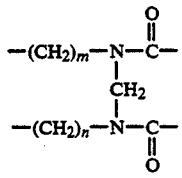

wherein m and n are positive integers, said crosslinked polyamide being N-methoxy methylated by a copolymer polyamide and treated with an organic acid;

a charge generating layer formed on said undercoat layer; and a charge transporting layer formed on said charge generating layer.

2. The photoconductor as claimed in claim 1, wherein said copolymer polyamide is a graftcopolymer polyamide, and wherein said organic acid is oxalic acid.

3. The photoconductor as claimed in claim 1, wherein said undercoat layer has a thickness ranging from 0.1 μm to 20 μm.

4. The photoconductor as claimed in claim 1, wherein said charge transporting layer includes a charge transporting substance which is a compound represented by formula (II):

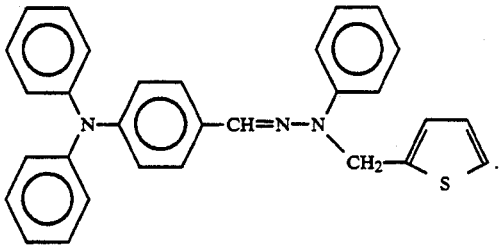

(II)

* * * * *